United States Patent [19]

Pinkney et al.

[11] Patent Number: 4,932,328

[45] Date of Patent: Jun. 12, 1990

[54] RELOADABLE STUN GRENADE

[75] Inventors: Barry D. Pinkney; Donald L. Anderson, both of Jefferson, Ohio

[73] Assignee: Def-Tec Corporation, Rock Creek, Ohio

[21] Appl. No.: 369,303

[22] Filed: Jun. 21, 1989

[51] Int. Cl.[5] ..... F42B 8/12; F42B 12/00

[52] U.S. Cl. ..... 102/482; 102/368; 102/487; 102/498

[58] Field of Search ..... 102/334, 367, 368, 369, 102/370, 395, 353, 445, 473, 482, 487, 498, 502, 529; 89/1, 11; 446/397–400

[56] References Cited

U.S. PATENT DOCUMENTS

| | | | |
|---|---|---|---|
| 1,539,609 | 5/1925 | Taylor | 102/498 |
| 3,492,945 | 2/1970 | Filippi | 102/498 |
| 3,505,959 | 4/1970 | Lohnert et al. | 102/487 |
| 3,599,571 | 8/1971 | Richardson | 102/368 |

FOREIGN PATENT DOCUMENTS

| | | | |
|---|---|---|---|
| 2007339 | 5/1979 | United Kingdom | 102/487 |

*Primary Examiner*—Harold J. Tudor

*Attorney, Agent, or Firm*—Renner, Otto, Boisselle & Sklar

[57] ABSTRACT

Stun grenade includes a steel housing having a steel tubular body with steel end members brazed to the ends of the tubular body, and a brass collar member threadably received in a threaded central opening in one of the end members for supporting an explosive charge in the housing. At the inner end of the collar member is a cylindrical portion to which a tubular container filled with the explosive charge is attached. The outer diameter of the tubular container is less than the minimum diameter of the threaded opening in the one end member to permit the tubular container to be inserted through the threaded opening while attached to the collar member. At the outer end of the collar member is a threaded recess for threaded receipt of a fuse member externally of the housing. A flash hole in the collar member directs a flash which is produced when the fuse member is activated into the tubular container to ignite the explosive charge.

24 Claims, 1 Drawing Sheet

RELOADABLE STUN GRENADE

BACKGROUND OF THE INVENTION

This invention generally relates to a stun grenade intended for use by trained law enforcement personnel and the like during tactical entry of barricaded or other high risk suspect areas. When detonated, the grenade produces a loud report accompanied by a brilliant flash that disorients those persons affected.

Stun grenades of this type are generally known. However, there is a need for a stun grenade that can easily be reloaded for both relatively low cost tactical and training purposes. Also, there is a need for a stun grenade that substantially eliminates the possibility of one or more parts thereof being propelled as a projectile by the force of the explosion. Furthermore, there is a need for a stun grenade that can be thrown directly through most windows and screens without having to break the window or cut the screen beforehand.

SUMMARY OF THE INVENTION

With the foregoing in mind, it is a principal object of this invention to provide a stun grenade that can safely be reloaded and reused a number of times thus making it cost effective for use for both tactical and training purposes.

Another object is to provide such a stun grenade that substantially eliminates the possibility of any part thereof becoming a projectile by the force of the explosion.

Still another object is to provide such a stun grenade that can be thrown directly through most windows and screens without first having to break the window or cut the screen.

Still another object is to provide such a stun grenade that protects the explosive charge from live gunfire hits.

Yet another object is to provide such a stun grenade that minimizes accidental injury by directing the force of the explosion out through the ends of the grenade rather than through the sides.

These and other objects of the present invention may be achieved by providing the stun grenade with a steel housing that can be reloaded with an explosive charge a number of times for low cost tactical and training purposes. To that end, a special collar member is threadably received in a threaded central opening in one end of the steel housing. At the inner end of the collar is a reduced diameter cylindrical end portion to which a cardboard tube containing the desired amount of explosive charge is attached for insertion through such threaded opening in the steel housing. At the outer end of the collar is a threaded recess for threaded engagement by a fuse member exteriorly of the housing. At the bottom of the recess is a flash hole for directing the flash that is produced when the fuse is activated into the cardboard tube to ignite the explosive charge. An adhesive tab that is easily burned through by the flash is desirably placed over the flash hole in the collar to prevent any portion of the explosive charge from getting up inside the collar during storage and handling.

The steel housing is also desirably sufficiently strong to protect the explosive charge from live gunfire hits and allows the grenade to be thrown directly through most windows and screens without prior breaking of the windows or cutting of the screens. Accidental injury is also minimized by constructing the grenade so that no parts can fly off during the explosion and by directing the force of the explosion out through the ends of the housing rather than through the sides.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
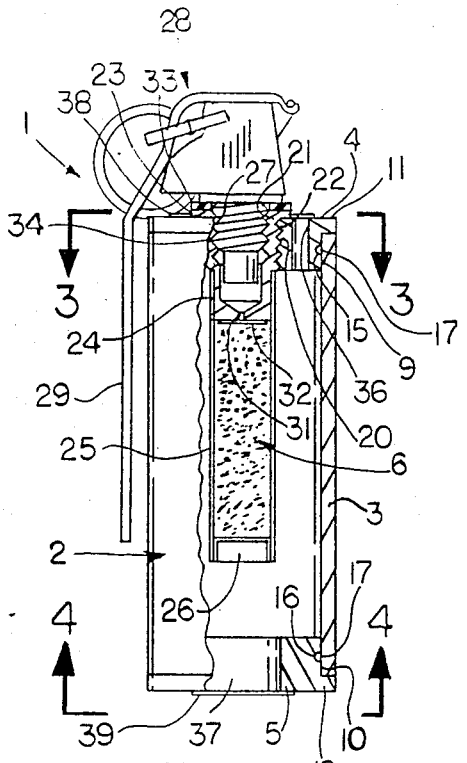
FIG. 1 is a fragmentary longitudinal section through a preferred form of stun grenade constructed in accordance with this invention.

Referring now in detail to the drawings, and initially to FIG. 1, a preferred form of stun grenade in accordance with this invention is generally indicated by the reference numeral 1 and includes a housing 2 consisting of a tubular steel body 3 having steel end members 4, 5 brazed to the ends thereof. Although the dimensions of the steel tubing 3 may vary within limits, its outer diameter should be of a size that fits comfortably within the palm of the user's hand. Also, the strength of the tubing should be such that it will not only withstand the internal blast pressures when an explosive charge 6 contained therein is detonated, but will also protect the explosive charge against being hit by live gunfire. Moreover, the weight of the stun grenade should be such that it can readily be thrown directly through most windows and screens without prior breaking or cutting. To that end, the tubular body 3 is desirably made out of $\frac{1}{8}$ inch drawn over mandrel (D.O.M.) welded steel tubing having an outer diameter (O.D.) of approximately $1\frac{7}{8}$ inches and an inner diameter (I.D.) of approximately $1\frac{5}{8}$ inches and an overall length of approximately $4\frac{1}{8}$ inches.

The end members 4, 5 are also desirably made out of a suitable steel having the desired strength to withstand the force of the blast, such as 12L14 steel, and include cylindrical end portions 9, 10 having an O.D. slightly less than the I.D. of the steel tubing 3 for close sliding receipt in the ends thereof and flanges 11, 12 at the opposite end extending radially outwardly beyond the cylindrical portions 9, 10 a distance substantially corresponding to the thickness of the tubing 3 for abutting engagement against the ends thereof with the O.D. of the flanges 11, 12 substantially flush with the O.D. of the tubing 3. Such cylindrical portions 9, 10 may, for example, have a length of approximately $\frac{3}{8}$ inch and the flanges 11, 12 a thickness of approximately $\frac{1}{8}$ inch. Also, semi-annular grooves 15, 16 having a maximum width and depth, for example, of approximately 0.070 inch, are provided in the O.D. of the cylindrical portions 9,

10 intermediate the length thereof for receipt of copper brazing wire 17 which, when heated in the grooves after the end members 4, 5 have been inserted into the ends of the tubing 3, causes the end members 4, 5 to be brazed to the ends of the steel tubing 3 along substantially the entire length of the cylindrical portions 9, 10 and width of the flanges 11, 12 around substantially their entire peripheries to provide a secure joint therebetween.

Figure 2:
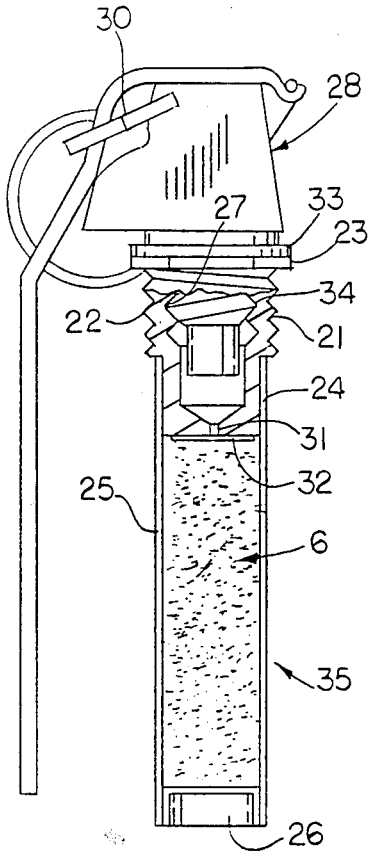
FIG. 2 is an enlarged fragmentary longitudinal section through the reload portion of the stun grenade of FIG. 1.

To mount an explosive charge 6 of the desired size within the steel housing 2, end member 4 has a threaded central opening 20 therethrough (see FIGS. 1 and 3) for threaded engagement by a special collar member 21 which, as clearly shown in FIGS. 1 and 2, includes an external threaded portion 22 for threaded engagement in the threaded opening 20 and a non-circular head 23 at the axial outer end thereof to facilitate tightening and loosening of the collar member 21 within the threaded opening 20. At the axial inner end of the collar member 21 is a cylindrical end portion 24 of reduced diameter to provide for attachment of a cardboard tube 25 or the like containing the explosive charge 6 to such cylindrical end portion 24. The O.D. of the cylindrical end portion 24 is slightly less than the minimum diameter of the threaded opening 20 in the end member 4 so that the cardboard tube 25 with explosive charge 6 contained therein can freely be inserted into the interior of the housing 2 while attached to the collar member 21 and the collar member 21 screwed into the threaded opening 2 to support the explosive charge 6 within the housing 2. In the preferred embodiment disclosed herein, the threaded opening 20 has $\frac{7}{8}$ inch$\times$14 threads and the cylindrical end portion 24 has an O.D. of approximately 0.675 inch and an axial length of approximately 0.450 inch for supporting a cardboard tube 25 having an O.D. of approximately 0.750 inch and a length of approximately 3 $\frac{1}{2}$ inches which is sufficient to hold approximately 15 ounces of a standard mix of flash powder. At the bottom of the tube 25 is a cardboard plug 26 which may be glued in place to retain the explosive charge 6 within the tube. To attach the cardboard tube 25 to the collar member 21, the tube 25 is slid over the collar end portion 24 and pushed up against the bottom of the threads 22 and secured in place with a suitable adhesive.

Within the outer end of the collar member 21 is a threaded recess 27 for threaded receipt of a fuse member 28 to support the fuse member 28 exteriorly of the housing 2 when the collar member 21 is threaded into the housing opening 20 as shown in FIG. 1. Fuse member 28 may be a standard military type fuse member including a fuse lever 29 held in place by a removable pin 30. When the pin 30 is removed, fuse lever 29 is released, which causes a delayed flash that travels through a flash hole 31 in the collar member 21 and ignites the flash powder 6 in the tube 25. Flash hole 31 is desirably between approximately 1/16 inch and $\frac{1}{8}$ inch in diameter, to assure ignition of the explosive charge 6 while preventing excess pressure from entering the collar member 21 and possibly ejecting the fuse 28 as a projectile.

For safety reasons, a self-adhesive tab or tape 32 made, for example, of chrome mylar, is desirably applied to the bottom of the collar member 21 to cover the flash hole 31 so that none of the explosive charge 6 contained within the cardboard tube 25 gets up in the collar recess 27. The flash that is produced by the fuse member 28 when the fuse member 28 is activated readily burns through the tab 32 and ignites the explosive charge 6.

To prevent moisture from entering the recess 27 in the collar member 21 when the fuse member 28 is threaded into the recess, a gasket 33 may be provided at the inner end of the threads 34 on the fuse member 28. Also for safety reasons, the collar member 21 is desirably made out of brass to eliminate any risk of sparking during assembly and disassembly of the fuse member 28, collar member 21 and housing 2. Making the collar member 21 out of brass has the further advantage that it will not rust so that the collar member 21 can easily be removed from the housing 2 to permit reloading of the housing 2 with a new explosive charge 6 and fuse member 28 (hereafter sometimes referred to collectively as a reload 35) for reuse of the housing 3 for low cost tactical and training purposes.

Figure 3:
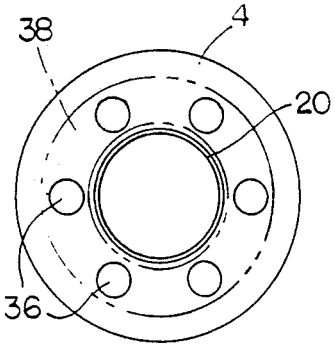
FIG. 3 is an enlarged top plan view of the stun grenade of FIG. 1 as seen from the plane of the line 3—3 thereof with the reload portion removed.
Figure 4:
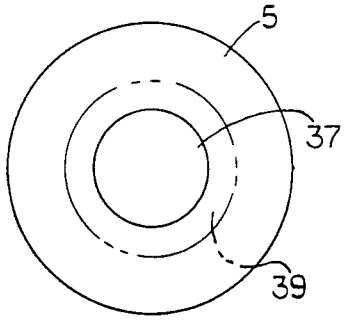
FIG. 4 is an enlarged bottom plan view of the stun grenade of FIG. 1 as seen from the plane of the line 4—4 thereof.

To prevent the stun grenade housing 2 from being blown apart by the force of the explosive charge when detonated, pressure relief holes are provided in the end members 4, 5 which direct the energy out through the ends of the housing 2 rather than through the sides formed by the steel tubing 3 which is impervious. As best seen in FIG. 3, a plurality of pressure relief holes 36 are provided in the end member 4 which contains the threaded opening 20 for the reload 35. The other end member 5, on the other hand, desirably has a single pressure relief hole 37 extending through the axial center (see FIGS. 1 and 4). Also, the area of the pressure relief hole 37 is desirably substantially the same as the combined areas of all of the pressure relief holes 36 in the end member 4 to substantially balance the pressures acting on the stun grenade 1 when the explosive charge 6 is detonated so that the stun grenade 1 will not be blown around by the force of the explosion.

Although the number and size of pressure relief holes 36 in the end member 4 may vary within limits, such holes 36 should be sufficiently large so that they do not become plugged by the ash which is produced when the explosive charge 6 is ignited. However, the size of the holes 36 is limited by the available wall thickness of the end member 4 taking into account the depth of the threaded opening 20 and brazing wire groove 15. In the preferred embodiment disclosed herein, six such pressure relief holes 36 are provided in the end member 4, each having a minimum diameter of approximately 15/64 inch. If smaller diameter holes were provided, some plugging of the holes 36 could result from the ash. Accordingly, it is desirable to make the holes 36 as large as the wall thickness of the end member 4 will permit, with approximately 15/64 inch being a minimum diameter.

More than one pressure relief hole may also be provided in the end member 5. However, providing a single relatively large center hole 37 having a diameter, for example, of approximately $\frac{3}{4}$ inch, makes it easier to perform pull tests on the housing 2 by inserting a gripper through the relatively large center hole 37 in end member 5 and threading another part of the test apparatus into the enlarged threaded opening 20 in the end member 4. Moreover, mylar self-adhesive tape 38, 39 or the like, which may be die cut to the desired shape, are desirably applied to the end members 4, 5 to cover the pressure relief holes 36, 37 therein as schematically shown in solid lines in FIG. 1 and in phantom lines in FIGS. 3 and 4 to keep out moisture and insects or the like which might otherwise interfere with the proper functioning of the stun grenade 1.

The overall dimensions of the fully assembled stun grenade 1 shown in FIG. 1 may of course vary within certain limits. However, as previously indicated, the stun grenade 1 should be of a size that fits comfortably within the palm of the user's hand. The stun grenade may, for example, have an overall outer diameter of approximately 1.98 inches and an overall length of approximately 5.95 inches. Also, the total weight of the stun grenade 1 is desirably approximately 25.7 ounces, which is sufficient to permit the stun grenade to be thrown through most windows and screens without prior breaking or cutting.

To use the stun grenade 1, the pin 30 is removed while continuing to hold the fuse lever 29 securely against the steel housing 2 until thrown. Then, the stun grenade 1 should be thrown underhand to an area which is free of personnel and ignitable material. After the explosive charge 6 has gone off, the grenade 1 can be retrieved and reloaded a number of times simply by unscrewing the collar member 21 from the housing 2 and replacing same with a new reload 35 including the same or different collar member 21 with cardboard tube 25 containing a new explosive charge 6 attached to the inner end 24 of the collar member and a new fuse member 28 attached to the outer end of the collar member.

From the foregoing, it will now be apparent that the steel housing for the stun grenade of the present invention has the advantage that it can be reloaded a number of times for low cost tactical and training purposes. Also, the steel housing protects the explosive charge from live gunfire hits and can be thrown directly through most windows and screens without prior breaking or cutting. Moreover, accidental damage is minimized by directing the energy out of the ends of the steel housing rather than through the sides.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A reloadable stun grenade comprising a metal housing including a metal tubular body having first and second metal end members secured to opposite ends of said body, a threaded opening in one of said end members, a collar member threadably engageable in said threaded opening, said collar member having a cylindrical inner end portion, a tubular container filled with an explosive charge attached to said cylindrical inner end portion, said tubular container having a diameter slightly less than the diameter of said threaded opening to permit said tubular container to be inserted through said threaded opening while attached to said collar member, a recess in an outer end portion of said collar member for threadably supporting a fuse member exteriorly of said housing when said collar member is threaded into said threaded opening in said one end member, flash hole means in said collar member for directing a flash which is produced when said fuse member is activated into said tubular container to ignite said explosive charge, and pressure relief hole means in said end members for relieving the energy that is produced when said explosive charge is ignited out through the ends of said housing.

2. The stun grenade of claim 1 wherein said recess in said collar member is internally threaded for threaded engagement by a threaded end portion of said fuse member.

3. The stun grenade of claim 1 further comprising tape means on said collar member covering said flash hole means to prevent any of said explosive charge from entering said recess through said flash hole means.

4. The stun grenade of claim 1 wherein there are a plurality of circumferentially spaced pressure relief hole means in said one end member.

5. The stun grenade of claim 4 wherein each of said pressure relief hole means in said one end member has a minimum diameter of approximately 15/64 inch.

6. The stun grenade of claim 4 wherein there are six of said pressure relief hole means in said one end member.

7. The stun grenade of claim 4 wherein there is a single pressure relief hole means in said other end member which has an area substantially equal to the combined areas of all of said pressure relief hole means in said one end member.

8. The stun grenade of claim 7 wherein said single pressure relief hole means in said other end member has a diameter of approximately $\frac{3}{4}$ inch, and each of said pressure relief hole means in said one end member has a diameter of approximately 15/64 inch.

9. The stun grenade of claim 1 wherein said tubular body is made of $\frac{1}{8}$ inch drawn over mandrel welded steel tubing.

10. The stun grenade of claim 1 wherein said end members are made of 12L14 steel.

11. The stun grenade of claim 1 wherein said end members are brazed to the ends of said tubular body.

12. The stun grenade of claim 11 wherein each of said end members includes a cylindrical end portion closely slidably received in the ends of said tubular body, and a flange at the other end in abutting engagement with the ends of said tubular body.

13. The stun grenade of claim 12 wherein the outer diameter of each of said flanges is substantially flush with the outer diameter of said tubular body.

14. The stun grenade of claim 12 further comprising external groove means intermediate the ends of said cylindrical portions of said end members for receipt of copper brazing wire in said groove means prior to insertion of said end members in the ends of said tubular body and applying heat thereto to braze said end members to said tubular body.

15. The stun grenade of claim 14 wherein said end members are brazed to the ends of said tubular body substantially throughout the length of said cylindrical portions and the width of said flanges which are in abutting engagement with the ends of said tubular body.

16. The stun grenade of claim 1 wherein there are a plurality of relatively small pressure relief hole means in said one end member and a single larger pressure relief hole means in said other end member having an area substantially equal to the combined areas of all of said pressure relief hole means in said one end member.

17. The stun grenade of claim 16 wherein said pressure relief hole means in said other end member is in substantial coaxial alignment with said threaded opening in said one end member.

18. The stun grenade of claim 1 wherein said explosive charge comprises approximately 15 ounces of flash powder.

19. The stun grenade of claim 1 wherein said collar member has external threads axially outwardly of said cylindrical inner end portion which, threadably, engage said threaded opening in said one end member, and said tubular container is pushed up against the bottom of said external threads and adhesively secured to said cylindrical inner end portion.

20. The stun grenade of claim 1 wherein said collar member is made of brass.

21. A stun grenade comprising a housing including a tubular steel body having first and second steel end members brazed to opposite ends of said body, means for reloading said housing with an explosive charge through one of said end members and for supporting a fuse member externally of said housing for igniting said explosive charge upon activating said fuse member, each of said end members including a cylindrical portion closely slidably received in the ends of said tubular body, and a flange in abutting engagement with the ends of said tubular body, external groove means intermediate the ends of cylindrical portions for receipt of brazing wire prior to insertion of said end members into the ends of said tubular body and applying heat thereto to braze said end members to said tubular body, and pressure relief hole means in said end members for relieving the energy that is produced when said explosive charge is ignited out through the ends of said housing.

22. The stun grenade of claim 21 wherein said end members are brazed to the ends of said tubular body substantially throughout the length of said cylindrical portions and width of said flanges which are in abutting engagement with the ends of said tubular body.

23. The stun grenade of claim 21 wherein there are a plurality of said pressure relief hole means in said one end member and a single pressure relief hole means in the other end member which has an area substantially equal to the combined areas of all of said pressure relief hole means in said one end member.

24. The stun grenade of claim 23 wherein said means for reloading said housing with an explosive charge and for supporting a fuse member externally of said housing comprises collar means threadably engageable in a threaded central opening through said one end member, said plurality of pressure relief hole means in said one end member being circumferentially spaced around said threaded central opening, and said single pressure relief hole means in said other end member being in substantially coaxial alignment with said threaded central opening in said one end member.

* * * * *